US011897076B2

(12) United States Patent
Allison

(10) Patent No.: US 11,897,076 B2
(45) Date of Patent: Feb. 13, 2024

(54) KNIFE SHARPENER WITH CLAMPING ASSEMBLY

(71) Applicant: Clay A. Allison, Sante Fe, NM (US)

(72) Inventor: Clay A. Allison, Sante Fe, NM (US)

( * ) Notice: Subject to any disclaimer, the term of this patent is extended or adjusted under 35 U.S.C. 154(b) by 525 days.

(21) Appl. No.: 17/235,265

(22) Filed: Apr. 20, 2021

(65) Prior Publication Data

US 2022/0331926 A1 Oct. 20, 2022

(51) Int. Cl.
*B24B 3/54* (2006.01)
*B24B 41/06* (2012.01)

(52) U.S. Cl.
CPC ..... *B24B 3/543* (2013.01); *B24B 41/06* (2013.01)

(58) Field of Classification Search
CPC ..... B24B 3/543; B24B 3/54; B24B 41/06
USPC ..... 76/88, 82; 451/45, 369, 364, 365, 367, 451/368, 372, 371, 370, 386, 321, 349, 451/344
See application file for complete search history.

(56) References Cited

U.S. PATENT DOCUMENTS

| | | | |
|---|---|---|---|
| 3,640,900 | A | 5/1887 | Clayton |
| 4,745,660 | A | 5/1892 | Rittenhouse |
| 6,366,480 | B2 | 11/1899 | Farmer |
| 1,506,643 | A | 8/1924 | Johnson |
| 2,116,343 | A | 5/1938 | Davis |
| 2,127,289 | A | 8/1938 | Corrall et al. |
| 2,142,105 | A | 1/1939 | Blankner |
| 2,157,816 | A | 5/1939 | Carosi |
| 2,191,899 | A | 2/1940 | Primak |
| 2,259,095 | A | 10/1941 | Aiello, Sr. |
| 2,370,908 | A | 3/1945 | Llorens |
| 2,397,256 | A | 3/1946 | Foster |
| 2,528,943 | A | 11/1950 | Calabrese |
| 2,809,539 | A | 10/1957 | Hennessy |
| 3,219,376 | A | 11/1965 | Peters |

(Continued)

FOREIGN PATENT DOCUMENTS

| | | | |
|---|---|---|---|
| CA | 2331369 | A1 | 11/1999 |
| CA | 2367189 | A1 | 7/2002 |

(Continued)

OTHER PUBLICATIONS

Duco, "Five Cylinders Pump Cam Disk," http://www.cnducoo.com/five-cylinders-pump-cam-disk.html (accessed Feb. 23, 2021).

(Continued)

*Primary Examiner* — Phong H Nguyen
(74) *Attorney, Agent, or Firm* — Finch & Maloney PLLC

(57) ABSTRACT

A clamping assembly includes first and second jaws supported above a base in opposed, spaced-apart alignment on opposite sides of a central clamp axis, each jaw having a proximal end portion adjacent the base and an opposite distal end portion, where the jaws are pivotable between an open position and a closed position. A wedge movable along the central clamp axis between the proximal end portions of the pair of jaws in response to moving a handle between a first handle position and a second handle position. A cam assembly between the wedge and the base includes a cam, a follower on the proximal handle end portion, and a spring between the cam and the base. Compressing the spring increases an axial distance between the cam and the wedge.

20 Claims, 9 Drawing Sheets

(56) References Cited

U.S. PATENT DOCUMENTS

| | | | | |
|---|---|---|---|---|
| 3,630,391 | A | 12/1971 | Wilson | |
| 4,216,627 | A | 8/1980 | Westrom | |
| 4,217,735 | A | 8/1980 | McGeoch et al. | |
| 4,404,873 | A | 9/1983 | Radish | |
| 4,441,279 | A | 4/1984 | Storm et al. | |
| 4,471,951 | A | 9/1984 | LeVine | |
| 4,512,112 | A | 4/1985 | LeVine | |
| 4,538,382 | A | 9/1985 | Johannsen | |
| 4,602,531 | A | 7/1986 | Korhonen | |
| 4,624,079 | A | 11/1986 | Bonapace | |
| 4,714,239 | A | 12/1987 | LeVine | |
| 4,731,953 | A | 3/1988 | Owen | |
| 4,777,770 | A | 10/1988 | LeVine | |
| 4,912,885 | A | 4/1990 | Bonapace | |
| 4,955,593 | A | 9/1990 | Yang | |
| 4,961,288 | A | 10/1990 | Ketteringham | |
| 5,157,870 | A | 10/1992 | Pike | |
| 5,185,958 | A | 2/1993 | Dale | |
| 5,195,275 | A | 3/1993 | McLean | |
| 5,218,787 | A | 6/1993 | Rice | |
| 5,318,004 | A | 6/1994 | Peck | |
| 5,363,602 | A | 11/1994 | Anthon et al. | |
| 5,431,068 | A | 7/1995 | Alsch | |
| 5,477,753 | A | 12/1995 | Branscum et al. | |
| 5,906,534 | A | 5/1999 | Folkman et al. | |
| 6,003,360 | A | 12/1999 | Runk et al. | |
| 6,146,257 | A | 11/2000 | Himeno et al. | |
| 6,168,509 | B1 | 1/2001 | Presgrove | |
| 6,505,871 | B2 | 1/2003 | McCormick | |
| 6,579,163 | B1 | 6/2003 | Ross et al. | |
| 6,659,439 | B1 | 12/2003 | Baumgartner et al. | |
| 6,726,551 | B2 | 4/2004 | Friel, Sr. | |
| 6,763,819 | B2 | 7/2004 | Eckert | |
| 7,019,510 | B1 | 3/2006 | Shirk | |
| 7,052,385 | B1 | 5/2006 | Swartz | |
| 7,144,310 | B2 | 12/2006 | Longbrake | |
| 7,413,504 | B2 | 8/2008 | Lytinas | |
| 7,867,062 | B2 | 1/2011 | Swartz | |
| 8,016,279 | B1 | 9/2011 | Su | |
| 8,262,438 | B1 | 9/2012 | Allison et al. | |
| 8,544,919 | B2 | 10/2013 | Oh et al. | |
| 8,794,612 | B2 | 8/2014 | Chuang | |
| 9,216,488 | B2 | 12/2015 | Allison | |
| 9,452,508 | B2 | 9/2016 | Beechinor et al. | |
| 9,878,483 | B2 | 1/2018 | Leroux | |
| 10,131,028 | B1 * | 11/2018 | Allison | B24D 15/08 |
| 10,774,614 | B2 | 8/2020 | Allison | |
| 2002/0074705 | A1 | 7/2002 | Marusiak | |
| 2004/0077299 | A1 | 4/2004 | Friel, Sr. | |
| 2005/0048885 | A1 | 3/2005 | Longbrake | |
| 2005/0090184 | A1 | 4/2005 | Zhang et al. | |
| 2006/0086208 | A1 | 4/2006 | Gshwind, Sr. et al. | |
| 2007/0218819 | A1 | 9/2007 | Schwaiger et al. | |
| 2007/0249268 | A1 | 10/2007 | Swartz | |
| 2008/0096477 | A1 | 4/2008 | Lytinas | |
| 2008/0223101 | A1 | 9/2008 | Moeck et al. | |
| 2009/0088053 | A1 | 4/2009 | Hummel | |
| 2009/0183956 | A1 | 7/2009 | Berliant | |
| 2010/0295227 | A1 | 11/2010 | Hung | |
| 2011/0159791 | A1 | 6/2011 | Heng | |
| 2011/0177764 | A1 | 7/2011 | Schwartz | |
| 2012/0146351 | A1 | 6/2012 | Oh et al. | |
| 2012/0326375 | A1 | 12/2012 | Chuang | |
| 2013/0234382 | A1 | 9/2013 | Hofmann | |
| 2014/0335765 | A1 * | 11/2014 | Allison | B24B 3/54 451/369 |
| 2017/0173843 | A1 | 6/2017 | Leroux | |
| 2020/0180116 | A1 | 6/2020 | Combs et al. | |
| 2020/0338682 | A1 | 10/2020 | Allison | |

FOREIGN PATENT DOCUMENTS

| | | | |
|---|---|---|---|
| EP | 0910497 | A1 | 4/1999 |
| JP | 352051661 | A | 4/1977 |
| WO | 9106403 | | 5/1991 |
| WO | 2004037488 | A1 | 5/2004 |
| WO | 2007048165 | A1 | 5/2007 |

OTHER PUBLICATIONS

B&H Photo-Video-Pro Audio, "Ikan Elements Pinch Clamp," available at https://www.bhphotovideo.com/c/product/820612-REG/Ikan_ELE_PN_Elements_Pinch_Clamp.html (accessed Feb. 24, 2021).

Eastwood, "Pinch Weld Clamps," available at https://www.eastwood.com/pinch-weld-clamps.html?gclid=EAlalQobChMlqJnHqJy_7QIVy_rICH3WBg-_EAkYBiABEgloVvD_BWE (accessed on Dec. 8, 2020).

Zhu et al., "Motion-Guided Mechanical Toy Modeling", Journal of ACM Transactions on Graphics, vol. 31, Issue 6 No. 127, available at http://audentia-gestion (Nov. 2012).

Dimensioning of Accessory Mounting Rail for Small Arms Weapons, MIL-STD-1913 (AR) (Feb. 3, 1995).

United States Patent and Trademark Office, Non-Final Office Action issued in U.S. Appl. No. 16/927,239 (dated Oct. 6, 2022).

* cited by examiner

KNIFE SHARPENER WITH CLAMPING ASSEMBLY

TECHNICAL FIELD

The present disclosure relates to a clamping assembly and a sharpening apparatus that includes the clamping assembly.

BACKGROUND

Cutting edges have been sharpened throughout history using a variety of methods. In one example, the blade of a knife or other tool is drawn by hand against a hone, such as a whetstone. In another example, the blade is held against a rotating abrasive wheel. The abrasive grit size of the hone can be selected to achieve the finished edge as desired, from rough sharpening to fine sharpening and polishing the cutting edge to a mirror finish. A variety of techniques can be used, depending on the type of tool to be sharpened, the shape of the cutting edge, the desired sharpness and durability of the edge, and other factors. In many sharpening methods, the blade to be sharpened is maintained at a particular angle with respect to the hone, whether by gripping in one's hand, using a vise, or some other method.

SUMMARY

One aspect of the present disclosure is directed to a clamping assembly particularly suited to hold a work piece during sharpening operations. In one such embodiment, the clamping assembly includes a pair of spaced-apart jaws positioned above a base and having opposed inner faces. Advancing a wedge between proximal ends of the jaws causes the distal ends of the jaws to pivot to a closed position. The wedge can be advanced along a central clamp axis by moving a handle from a first position to a second position, where a proximal end of the handle engages a cam to change the position of the wedge. In one example, the proximal end of the handle includes a roller that engages a cam surface to raise or lower a wedge along the central clamp axis between the jaws. For example, as the handle is moved to the second handle position, the roller moves up an inclined surface and in turn forces the wedge to move along the central clamp axis between the proximal ends of the jaws, pivoting the distal ends of the jaws towards the closed position.

In some clamping assemblies, the gap between the jaws can be adjusted to accommodate knives of different thicknesses. In making such an adjustment, the distal ends of the jaws may engage the knife blade before the handle reaches the second position (e.g., a clamped position). Setting the gap between the jaws to be overly small can result in not being able to move the handle fully to the second handle position and may also result in marring the surface of the knife blade. Setting the gap between the jaws to be overly large can result in insufficient clamping force to retain the blade during sharpening operations. Thus, the user may undergo a lengthy iterative process to achieve the optimal jaw spacing for each knife blade so that the jaws securely hold the blade without marring the surface.

To simplify adjustment and to reduce the need to find the exact jaw spacing for each knife blade, a spring between the cam and the base can be used to take up additional motion of the handle after the jaws engage the knife blade. Thus, after the jaws engage the knife blade, the follower can continue to move along the cam surface to a position of increased displacement because the spring compresses to take up the additional handle movement which otherwise may not occur since the jaws, knife blade, and other components are typically made of incompressible materials. Accordingly, a single clamp setting can be used for knives or workpieces of different thicknesses because the spring compression enables the clamping assembly to self-adjust so that the handle can be moved fully to the second handle position after the jaws engage the blade.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
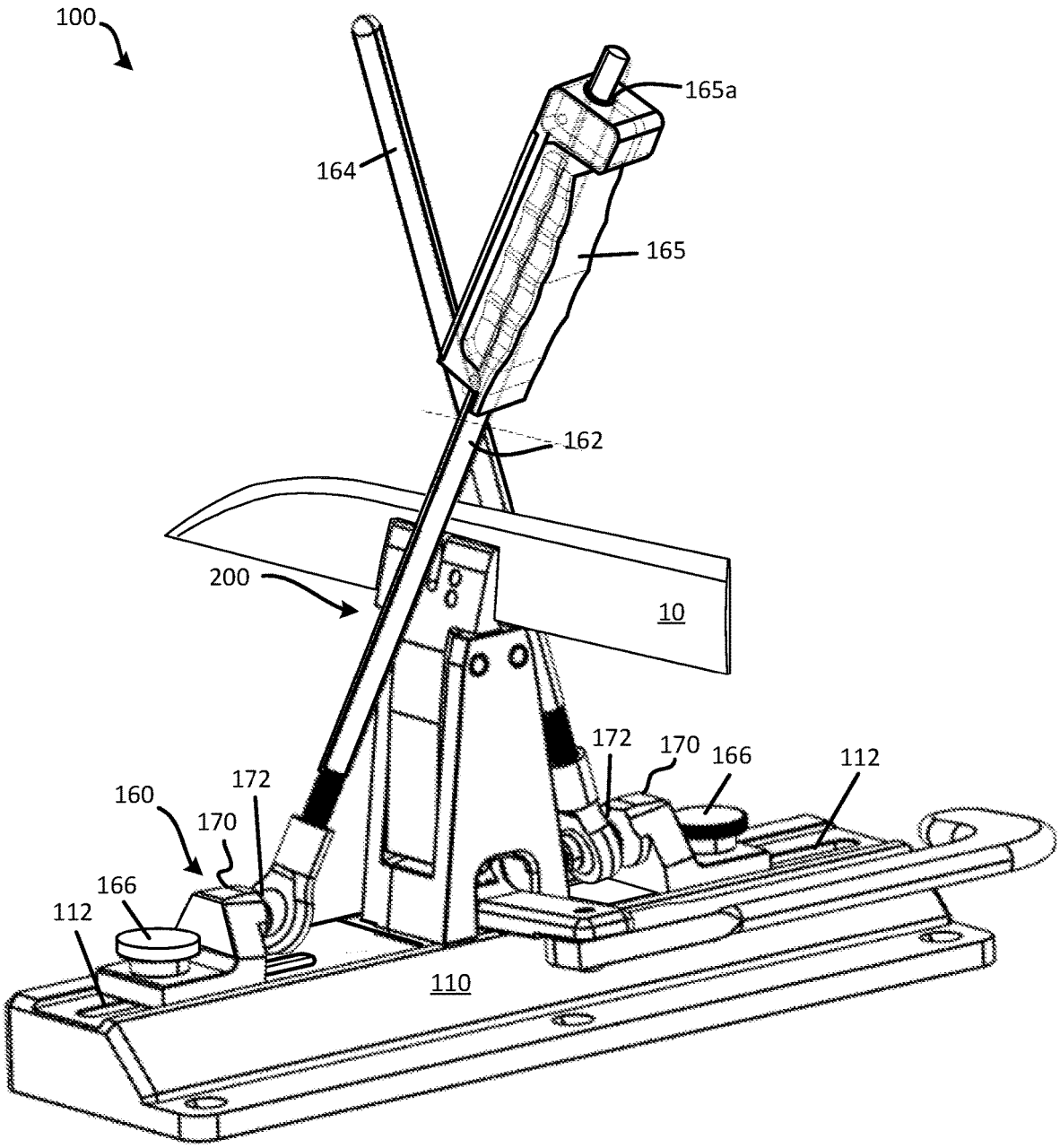
FIG. 1 is a perspective view of a sharpening assembly that includes a base oriented horizontally and clamping assembly with jaws extending upward from the base, in accordance with an embodiment of the present disclosure.

The figures depict various embodiments of the present disclosure for purposes of illustration only. Numerous variations, configurations, and other embodiments will be apparent from the following detailed discussion.

DETAILED DESCRIPTION

Disclosed is a clamping assembly that includes a pair of jaws supported in opposed, spaced-apart alignment on opposite sides of a central clamp axis. Each jaw has a proximal end portion and a distal end portion, where the jaws are pivotable between an open position and a closed position. A wedge is movable along the central clamp axis between the proximal end portions of the jaws in response to moving a handle between a first handle position and a second handle position. A cam assembly includes a cam, a follower on the proximal handle end portion, and a spring between the cam and a base. Compressing the spring increases an axial distance between the cam and the wedge, therefore enabling the follower to continue to move to a plateau or other stable position on the cam surface after the jaws engage a workpiece.

In accordance with one embodiment, when the jaws close on a metal knife blade or other workpiece prior to the handle moving fully to the second handle position, additional movement of the handle compresses the spring. In doing so, the cam travels axially away from the wedge and increases the axial distance between the wedge and the cam. Accordingly, the handle can be moved fully to the second handle position where the follower moves to a stable position on a peak, a plateau, or on the falling side of the peak, for example. The cam assembly simplifies adjustment and operation of the clamping assembly by enabling the clamping assembly to self-adjust to securely hold knife blades with a range of different thicknesses using a single setting for spacing between the jaws. Numerous variations and embodiments will be apparent in light of the present disclosure.

Overview

Some sharpening assemblies include a clamp to secure the work piece or blade to be sharpened. For example, the clamp may include a handle that is operated to draw together the clamp jaws to engage the spine of a knife and hold the knife securely during sharpening operations. A challenge for such clamp assemblies is the need to adjust the clamp to accommodate work pieces of different thicknesses so that clamping pressure is sufficient to securely hold the work piece during sharpening while also not marring the blade surface. Inadequate adjustment in the clamping force can also result in a clamping force that is inappropriate for the particular knife or other cutting implement, such as a force that either mars the finish of a knife or does not securely hold the cutting implement during sharpening. Similarly, cumbersome adjustments may discourage the user from making the necessary adjustment in the first place, leading to poor sharpening result or frustration in using the clamp.

Thus, a need exists for improvements to clamping assemblies of a knife sharpener assembly, such as a knife sharpener with a clamping assembly that facilitates clamping of knife blades of various thicknesses. The present disclosure addresses this need and others by providing a knife sharpener with a clamping assembly with a self-adjusting clamping force. In one example embodiment, a clamping assembly includes a handle that can be moved from a first position to a second position to close the clamp jaws on a blade or other work piece. An end of the handle is positioned below the proximal ends of the jaws and engages a cam to advance a wedge between the proximal ends of the jaws when moving the handle to the second position. When the jaws engage the knife blade, a spring between the cam and the base is compressed to take up additional movement of the handle to the second position. Numerous variations and embodiments will be apparent in light of the present disclosure.

As discussed herein, terms referencing direction, such as upward, downward, vertical, horizontal, left, right, front, back, etc., are used for convenience to describe embodiments of a sharpener with a clamping assembly, where the sharpener has a base extending in a horizontal plane. Embodiments in accordance with the present disclosure are not limited by these directional references and it is contemplated that the sharpener and/or its clamping assembly could have or be used in any orientation.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter

EXAMPLE EMBODIMENTS

FIG. 1 illustrates a front perspective view of a sharpening assembly 100, in accordance with an embodiment of the present disclosure. The sharpening assembly 100 includes a base 110, a clamping assembly 200 mounted on the base 110, and a guide rod assembly 160 movably mounted on the base 110. The guide rod assembly 160 includes a first guide rod 162 and a second guide rod 164, each of which is pivotably connected to a rod mount 170 that is movably attached to the base 110. In the example shown, each rod 160, 162 is connected to the rod mount 170 via ball-and-socket joint 172. In one embodiment, each rod mount 170 can be secured to the base 110 along a slot 112 using fasteners 166. For example, each rod mount 170 can be positioned along the respective slot 112 and then secured in place by tightening the fastener 166 to draw the rod mount 170 tight against the base 110. Accordingly, each guide rod 162, 164 can be selectively positioned on opposite lateral sides of the clamping assembly 200 to guide a hone 165 in a reciprocal motion along each guide rod 162, 164 to sharpen a workpiece 10 (e.g., a knife) retained in the jaws of the clamping assembly 200. Using this approach, a sharpening angle between the hone 165 and the workpiece 10 can be adjusted and then fixed as desired for a particular workpiece 10. Although two guide rods 162, 164 and two rod mounts 170 are shown, this is not required and the sharpening assembly 100 may be used with one guide rod 162 and a single rod mount 170.

In accordance with one embodiment, the hone 165 is configured to slide along guide each guide rod 162, 164 via a longitudinal opening 165*a* that extends through the hone 165 from end to end. In one embodiment, the hone 165 generally has a rectangular cross-sectional shape and includes an abrasive material on one or more of the hone 165 faces. The grinding or honing material may take any of a number of forms and can vary from a coarse grit to a fine grit (for example, 80 to 1600 grit).

Figure 2A:
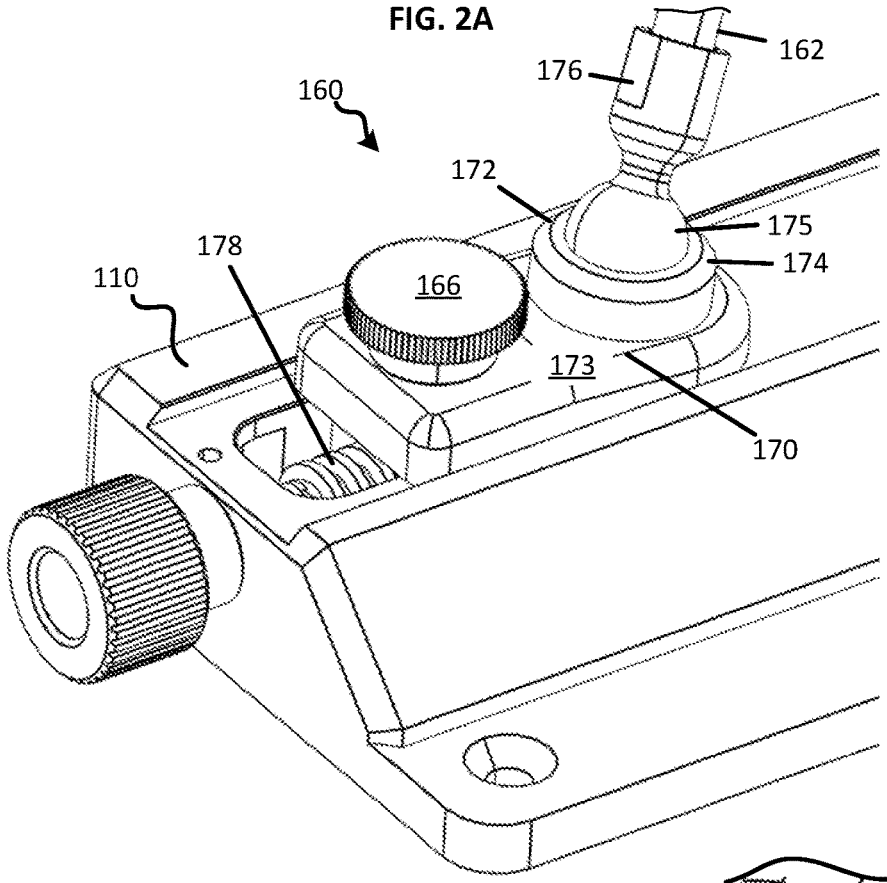
FIG. 2A illustrates a top and front perspective view of part of the base with a guide rod assembly, in accordance with an embodiment of the present disclosure.
Figure 2B:
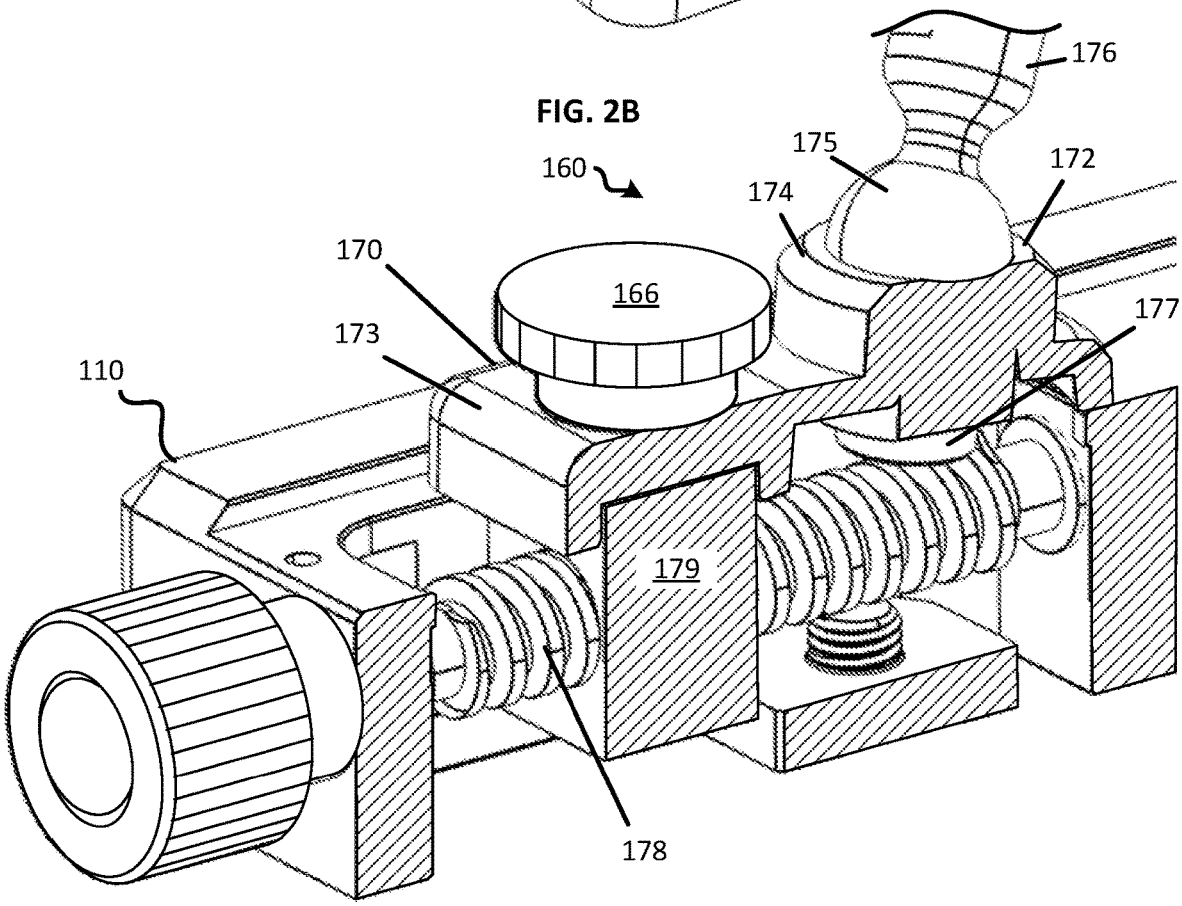
FIG. 2B illustrates a perspective, cross-sectional view of the guide rod assembly of FIG. 2A.

Referring now to FIGS. 2A and 2B, a top perspective view and a perspective, cross-sectional view show a portion of the base 110 and guide rod assembly 160 for first guide rod 162, in accordance with an embodiment of the present disclosure. In this example, the rod mount 170 includes a ball-and-socket joint 172 on a mount base 173 that is movably attached to the base 110. The ball-and-socket joint 172 includes a hemispherical receptacle 174 sized to receive the ball 175 on a rod connector 176 coupled to the first guide rod 162. In some embodiments, the hemispherical receptacle 174 is magnetized to retain the ball 175. For example, the receptacle 174 is or includes a permanent magnet 177. Alternately, the mount base 173 includes a permanent magnet 177 below the receptacle 174, such as shown in FIG. 2B.

The mount base 173 is laterally movable along the base 110 by operating a lead screw 178. In the example shown, the lead screw 178 is installed into the base 110 below the guide rode assembly 160 and engages the mount base 173, such as extending through a threaded opening in a block 179 or equivalent structure on the bottom of the mount base 173.

The distal end of the lead screw 178 is received in the base 110 such that the lateral position of the lead screw 178 does not change the lead screw 178 is rotated. As the lead screw 178 is rotated in a first direction, it threadably engages the block 179 to move the guide rod assembly 160 linearly along the base 110 in a first lateral direction (e.g., towards the clamping assembly 200). As the lead screw 178 is rotated in an opposite second direction, the guide rod assembly 160 moves linearly along the base 110 in an opposite second lateral direction (e.g., away from the clamping assembly 200). In doing so, the rod mount 170 moves along the top surface of the base 110. Thus, the lead screw 178 can be used to adjust the position of the guide rod assembly 160, and therefore the sharpening angle between a hone 165 and the work piece 10 (shown in FIG. 1). Optionally, the mount base 173 is a separate component from the block 179 and can be attached to the block 179 using a fastener 166.

Figure 3:
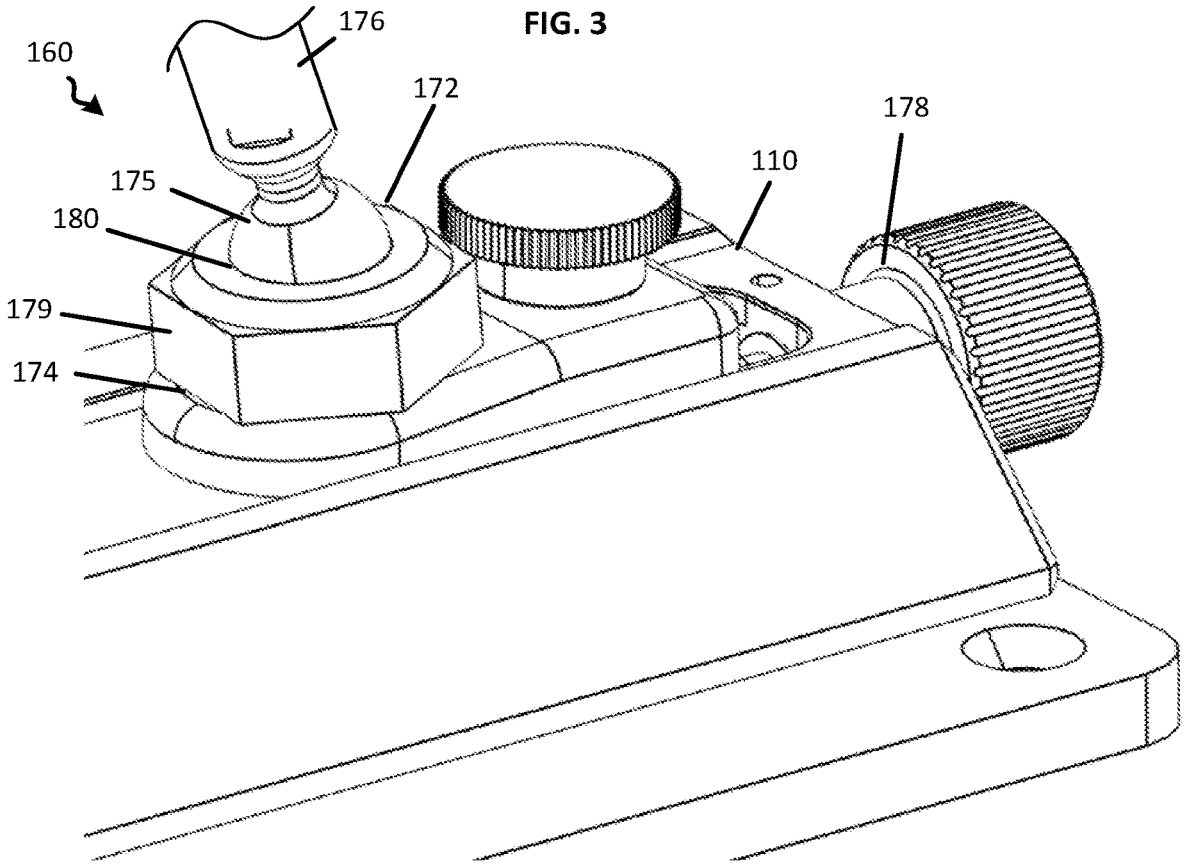
FIG. 3 is a perspective view of part of the base with a guide rod assembly, in accordance with another embodiment of the present disclosure.

Referring now to FIG. 3, a top and front perspective view illustrates part of the base 110 and a guide rod assembly 160 for the second guide rod 164, in accordance with an embodiment of the present disclosure. In this example, the ball-and-socket joint 172 includes a hemispherical receptacle 174 (not visible) that receives the ball 175 on the end of the rod connector 176. To securely retain the ball 175 in the receptacle 174, a nut 179 with an opening 180 is attached to the receptacle 174 to capture the ball 175 between the receptacle 174 and the nut 179 and with part of the ball 175 extending through the opening 180. In this example, the nut 179 securely retains the rod connector 176 throughout a range of movement by pivoting the ball 175 within the receptacle 174. Similar to the embodiment discussed above with reference to FIGS. 2A and 2B, the guide rod assembly 160 can be moved laterally along the base 110 by operating the lead screw 178.

Figure 4:
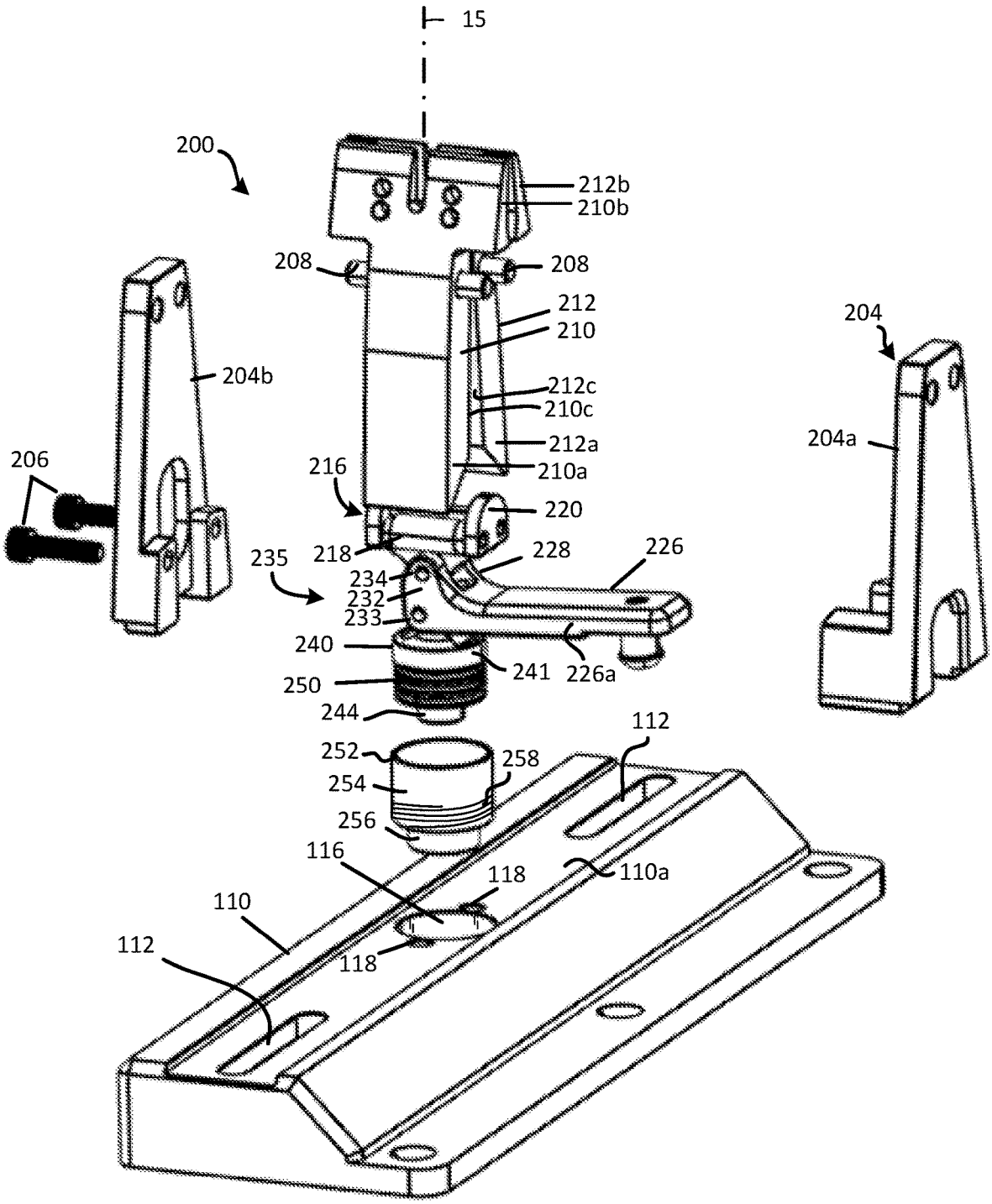
FIG. 4 is an exploded perspective view of the base and clamp assembly, in accordance with an embodiment of the present disclosure.

FIG. 4 illustrates an exploded perspective view of the base 110 and clamping assembly, in accordance with an embodiment of the present disclosure. The base 110 is oriented along a horizontal plane and defines longitudinal slots 112 in its top surface for movably attaching rod mounts 170 (shown in FIG. 1). In one embodiment, each rod mount 170 uses an interference fit between a fastener 166 and the wall of the slot 112 to fix the position of the rod mount 170. In other embodiments, each slot 112 extends vertically through the base 110 so that a bolt and nut can be used to secure a rod mount 170.

The base 110 also defines a spring well 116 located between slots 112. The spring well 116 extends into or through the base 110 along the central clamp axis 15. The spring well 116 can be a circular bore or have some other shape to suitable to receive a spring or springs 250. In some embodiments, all or part of cam 240 is received in the spring well 116 with spring(s) 250. Adjacent the spring well 116 are fastener openings 118 extending through the base 110 parallel to the central clamp axis 15. Fasteners can be installed through each fastener opening 118 and into an end (e.g., bottom end) of the clamp housing 204 to secure the housing 204 to the base 110. In this example, the front housing portion 204*a* can be secured to the base 110 using fasteners that extend through fastener openings 118 and into the bottom end of the front housing portion 204*a*. The rear housing portion 204*b* can be secured to the base 110 or can be secured to the front housing portion 204*a* with fasteners 206 that extend horizontally between the front and rear housing portions 204*a*, 204*b*. Numerous variations and embodiments will be apparent.

The clamping assembly 200 includes a first jaw 210 and a second jaw 212 each generally oriented along the central clamp axis 15. One or both of the first and second jaws 210, 212 are pivotably supported over the base 110 by the clamp housing 204. In this example, the central clamp axis 15 is a vertical axis passing between the jaws 210, 212 and through components of a cam assembly 235. The first jaw 210 has a proximal end portion 210*a*, a distal end portion 210*b*, and an inside surface 210*c*. The second jaw 212 similarly has a proximal end portion 212*a*, a distal end portion 212*b*, and an inside surface 212*c*. The second jaw 212 is positioned in opposed alignment with the first jaw 210 so that the inside surface 212*c* of the second jaw 212 faces and is spaced apart from the inside surface 210*c* of the first jaw 210.

Each of the first and second jaws 210, 212 can be pivotably mounted between the front housing portion 204*a* and rear housing portion 204*b* using one or more pins 208. In this example, each of the front housing portion 204*a* and rear housing portion 204*b* includes a plate extending away from the base 110 (e.g., a vertical plate extending upward from the base 110), where the front housing portion 204*a* and rear housing portion 204*b* are spaced apart to receive portions of the jaws 210, 212 between them. Pins 208 connecting the first and second jaws 210, 212 to the clamp housing 204 allow the jaws 210, 212 to pivot or rotate about the respective pin 208. Thus, each of the first jaw 210 and second jaw 212 can pivot about pin(s) 208 between an open position and a clamped position. One or both jaws 210, 212 thus can pivot about the pin(s) 208 to clamp a work piece 10 between the distal end portions 210*b*, 212*b*. In one embodiment, the pin(s) 208 connecting each jaw 210, 212 to the clamp housing 204 is positioned along the jaw 210, 212 so that a greater mass of the proximal end portion 210*a*, 212*a* biases the jaws 210, 212 towards the open position when the jaws 210, 212 are oriented vertically. In other embodiments, a spring between the distal end portions 210*b*, 212*b* may be used to bias the jaws 210, 212 to the open position. In other embodiments, one of the first or second jaws 210, 212 has a fixed position and the other of the first or second jaws 210, 212 pivots between the open and clamped positions.

A wedge 216 is positioned for movable engagement with the inside surfaces 210*c*, 212*c* of the proximal end portions 210*a*, 212*a* of the first and second jaws 210, 212, respectively. In embodiments where only one of the jaws 210, 212 pivots, the wedge 216 can be positioned to operate the pivoting jaw, as will be appreciated. In the assembled state of this example, the wedge 216 is positioned adjacent or between the proximal end portions 210*a*, 212*a* of the jaws 210, 212 such that the wedge 216 can be advanced along the central clamp axis 15 between the proximal end portions 210*a*, 212*a* to spread apart the proximal end portions 210*a*, 212*a* and cause the distal end portions 210*b*, 212*b* to pivot toward the closed position. For example, advancing the wedge 216 between the proximal end portions 210*a*, 212*a* along the central clamp axis 15 forces apart the proximal end portions 210*a*, 212*a* and causes the distal end portions 210*b*, 212*b* to pivot towards each other.

The wedge 216 can include a block, one or more rollers, or other structure that can movingly engage one or both of the proximal end portions 210*a*, 212*a*. In this example, the wedge 216 includes a pair of rollers 218, each positioned to engage one of the respective inside surfaces 210*c*, 212*c* of the first and second jaws 210, 212. The rollers 218 are retained in a roller frame 220 so that each roller 218 can rotate independently of the other as it travels along the respective inside surface 210*c*, 212*c* of the first or second jaws 210, 212. The roller frame 220 is operatively connected to the handle 226 so that moving the handle 226 between the first and second handle positions changes the position of the wedge 216 along the central clamp axis 15.

A cam assembly 235 is positioned between the wedge 216 and the base 110 (e.g., below the handle 226). In one embodiment, the cam assembly 235 includes a cam 240 retained by the base 110 and a follower 230 on the handle 226. For example, the cam 240 is a disc cam with a cam body 241 of cylindrical shape configured to be at least partially received in the spring well 116 with spring 250. A cam surface 242 (shown, e.g., in FIG. 6) is on the exposed surface (e.g., top surface) of the cam body 241. The follower 230 on the handle 226 moves along the cam surface 242 during operation of the handle 226. Other shapes for the cam 240 are acceptable, including oval, rectangular, hexagonal, etc.

The handle 226 has a proximal handle end portion 228 between the wedge 216 and the cam 240 and is operatively connected to the wedge 216. In this example, the proximal handle end portion 228 has a lever arm 232 that defines an L-shape or functional equivalent with the elongated handle body 226*a* of the handle 226, where the lever arm 232 is connected to the roller frame 220. As shown here, the lever arm 232 extends between a toe 234 connected to the wedge 216, and a heel 233 that includes a follower 230 (not visible). The toe 234 is pivotably connected to the wedge 216 by a pin or fastener such that pivoting the handle 226 from the first handle position to the second handle position moves the wedge 216 along the central clamp axis 15 in engagement with the proximal end portions 210*a*, 212*a* of first and second jaws 210, 212. In this example, the elongated handle body 226*a* pivots up and down to move the wedge 216 vertically along the central clamp axis 15.

The proximal handle end portion 228 includes one or more follower 230 shaped and configured to engage the cam surface 242 on the cam 240. In some embodiments, the follower 230 can move linearly with respect to the cam surface 242, such as a forward and backward motion when the handle is pivoted between the first and second handle positions. For example, the follower 230 is a roller that moves along a sloped cam surface 242 when the handle 226 is pivoted between the first and second handle positions.

In one example, the follower 230 is spaced from the toe 234 of the proximal handle end portion 228. As shown in the example of FIG. 4, the lever arm 232 extends transversely from the handle body 226*a* to a toe 234 that is connected to the roller frame 220. The follower 230 (shown in FIG. 6) is located at or near the heel 233. Pivoting the handle 226 from the first handle position (e.g., a generally upright position) to the second handle position (e.g., a generally horizontal position) moves the follower 230 along the cam surface 242 to change a distance between the wedge 216 and the base 110. Stated differently, movement of the follower 230 along the cam surface 242 changes a position of the wedge 216 along the central clamp axis 15. For example, pivoting the handle 226 to the second handle position causes the follower 230 (e.g., a roller) to roll up the cam surface 242 shaped as a ridge, an incline, a hill, or like structure on the cam body 241. For example, the cam surface 242 can have a domed, rounded, or trapezoidal shape and can have rising and/or falling edges that are linearly or curved sloped. The follower 230 occupies a stable position when positioned on a plateau, is on the falling side of a peak, or is in a recess, for example.

In addition to the follower 230 moving along the cam surface 242, movement of the handle 226 from the first handle position to the second handle position includes the lever arm 232 pivoting to an axial position along the central clamp axis 15 to advance the wedge 216 between the proximal end portions 210*a*, 212*a* of the first and second jaws 210, 212, in accordance with some embodiments. In more detail, the lever arm 232 changes orientation from a position transverse to the central clamp axis 15 to a generally axial position (e.g., an upright position along central clamp axis 15), thereby increasing the distance between the cam 240 and the wedge 216. Thus, in combination with the follower 230 moving with respect to the cam surface 242 to change the position of (e.g., lift) the wedge 216, moving the handle 226 from the first position to the second position also pivots the lever arm 232 to advance the wedge 216 along the central clamp axis 15 between the proximal end portions 210*a*, 212*a* of jaws 210, 212.

In other embodiments, the follower rotates with respect to the cam 240 when the handle 226 is moved from between the first and second handle positions. In one such embodiment, the proximal handle end portion 228 includes a plate oriented perpendicularly to the central clamp axis 15 (e.g., in a horizontal plane) and has one or more followers 230 on the bottom of the plate that engage respective cam surfaces 242 on the cam body 241. For example, the follower 230 includes rollers or surfaces positioned to engage respective cam surfaces 242 (e.g., ridges or inclines) distributed in a circle around the top surface of the cam body 241, where rotating the handle 226 causes the follower 230 to engage the cam surfaces 242 and change the distance between the proximal handle end portion 228 and the cam body 241, which in turn moves the wedge 216 along the central clamp axis 15. In one such embodiment, the top of the proximal handle end portion 228 is configured to connect to or engage the wedge 216 and move the wedge 216 along the central clamp axis 15, such as having a domed shape or a protrusion that is connected to or otherwise engages the wedge 216.

A spring 250 between the cam 240 and the base 110 is configured to absorb additional movement of the handle 226 after the distal end portions 210*b*, 212*b* of the first and second jaws 210, 212 engage the work piece 10. The spring 250 can include one or more of a helical coil spring, a disc spring (e.g., a Belleville washer), a polymer spring, a wave spring, a leaf spring, or other suitable spring. A gap between the first and second jaws 210, 212 will result in engagement with the work piece 10 at a corresponding position of the wedge 216 along the central clamp axis 15. When the work piece 10 is thicker than expected, for example, the first and second jaws 210, 212 may engage the work piece 10 before the handle 226 is moved fully to the second handle position. In the second handle position, for example, the follower 230 occupies a stable position, such as a recess or plateau, where the user must apply some force to the handle 226 to return the handle 226 to the first handle position. For example, the user-applied force moves the follower 230 over a hill-like cam surface 242, the lever arm 232 transitions through a truly axial position, or some other movement occurs that further compress the spring 250 an additional but relatively small amount prior to returning the handle 226 to the first handle position. Thus, when the handle 226 fails to move completely to the second handle position, the follower 230 may not reach a stable position on the cam surface 242 (e.g., a plateau or a position just beyond a peak) where the follower 230 may occupy a relatively lower energy position. Accordingly, the follower 230 may still be on a sloped portion of the cam surface 242 and the clamping assembly 100 may fail to maintain a clamped position on the work piece 10. To reduce or alleviate the need to adjust the first and second jaws 210, 212 for the thickness of each work piece 10, the spring 250 compresses after the jaws 210, 212 engage the work piece 10 to enable the handle 226 to be moved fully to the second handle position and the follower 230 to a stable position. Accordingly, the follower 230 can advance to a plateau or to a lower energy position on the cam surface 242 to maintain the clamped position.

In use, moving the handle 226 from the first handle position to the second handle position moves the wedge 216 along the central clamp axis 15 between and in engagement with one or both proximal end portions 210*a*, 212*a* of the first and second jaws 210, 212, thereby pivoting the distal end portions 210*b*, 212*b* to a closed position. Similarly, moving the handle 226 from the second handle position to the first handle position moves the wedge 216 in an opposite direction along the central clamp axis 15, thereby allowing the distal end portions 210*b*, 212*b* to assume an open position.

Optionally, the spring 250 is received in a receptacle 252 that in turn is received in the spring well 116. In one embodiment, the receptacle 252 has a receptacle body 254 with a hollow cylindrical shape and a receptacle base 256 of reduced diameter below the receptacle body 254. The receptacle 252 is received in the spring well 116 having a corresponding geometry. In one embodiment, the receptacle base 256 is configured to receive a stem 244 extending down from the cam body 241 and through the spring 250. In some embodiments, when the spring 250 is not compressed or otherwise is in a resting state, the stem 244 can be sized to be equal to or less than the axial dimension of the spring 250. When the spring 250 compresses, the stem 244 may extend beyond the spring 250 and into the receptacle base 256. In other embodiments, the stem 244 is greater in axial length than the axial dimension of the spring 250 in its resting position, which facilitates maintaining the position of the spring 250 with respect to the cam 240.

In some embodiments, the spring well 116 and outside surface of the receptacle 252 include threads 258 so that the receptacle 252 is threaded into the spring well 116. Accordingly, the axial position of the receptacle 252 in the spring well 116 can be adjusted by rotating the receptacle 252 to raise or lower its position with respect to the base 110. By advancing or retracting the receptacle 252 in the spring well 116, the receptacle 252 provides additional adjustment to the clamping assembly 200 by changing the axial distance between the cam 240 and the proximal end portions 210*a*, 212*a* of the first and second jaws 210, 212. As such, the clamping force and/or gap between the distal end portions 210*b*, 212*b* can be adjusted as desired.

In one example, where the clamping assembly 200 is used predominantly with small knives, the receptacle 252, and therefore a position of the spring 250 and cam 240, can be adjusted to be axially closer to the jaws 210, 212, moving them towards a closed position. For example, threading the receptacle 252 along the central clamp axis 15 moves the first and second jaws 210, 212 towards the clamped position. Similarly, when the clamping assembly 200 can be adjusted for thicker knives by turning the receptacle 252 in the spring well 116 to move the cam 240 and spring 250 further away from the first and second jaws 210, 212 and enable an increased gap between the distal end portions 210*b*, 212*b* of the jaws in the open position.

Figure 5:
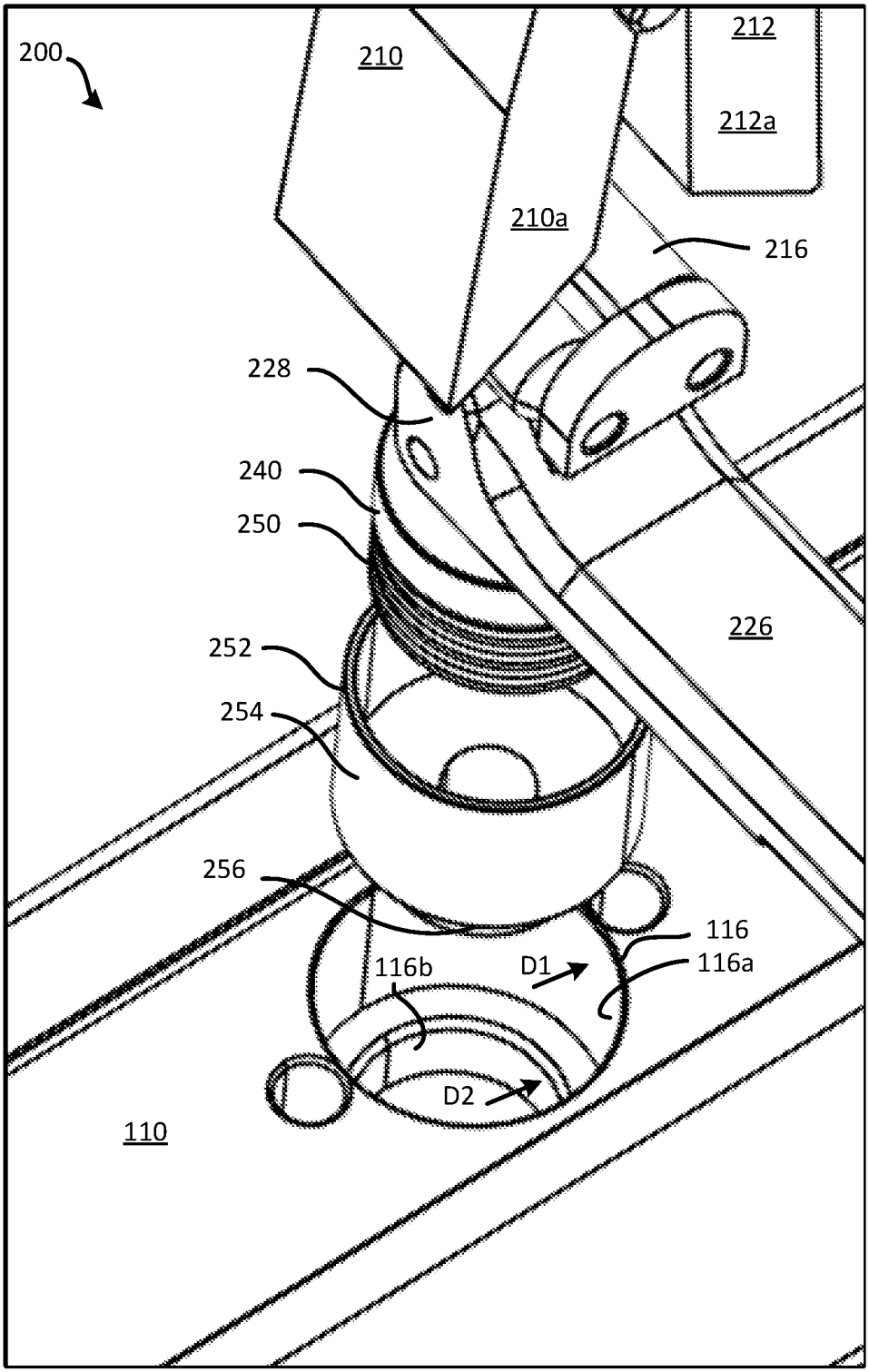
FIG. 5 is a top view looking into a spring well defined in the base and shows components of the clamp assembly in a partially exploded view, in accordance with an embodiment of the present disclosure.

Referring now to FIG. 5, an exploded perspective view looking into the spring well 116 from above shows components of the clamping assembly 200, in accordance with an embodiment of the present disclosure. In this example, the handle 226 is in the second handle position. The first and second jaws 210, 212, wedge 216, proximal handle end portion 228, cam 240, spring 250, and receptacle 252, and spring well 116 are aligned along the central clamp axis 15 (shown in FIG. 4). The spring well 116 has a first portion 116*a* with a first diameter D1 sized to receive the receptacle body 254 and a second portion 116*b* with a second diameter D2 sized to receive the receptacle base 256. In some embodiments, the first diameter D1 is sized for a slip fit or sliding fit between the receptacle body 254 and the first portion 116*a*. In some embodiments, the second diameter D2 can be sized for a slip fit or a loose fit with the receptacle base 256. In some such embodiments, the second portion 116*b* of the spring well 116 is defined by an insert that threadably engages the bottom portion of the spring well 116. By advancing or retracting the insert axially in the spring well 116, its position within the spring well 116 can be changed. In turn, the axial position of the cam 240 can be adjusted. Accordingly, the spring force or the amount of compression of the spring 250 can be adjusted as desired for the point of engagement of the clamping assembly 200 with a work piece 10. For example, to increase the clamping force on the work piece 10, the insert is rotated to move the receptacle 252 (if present) and spring 250 closer to the proximal end portions 210*a*, 212*a* of the first and second jaws 210, 212, thereby pivoting the jaws somewhat towards a closed position.

Figure 6:
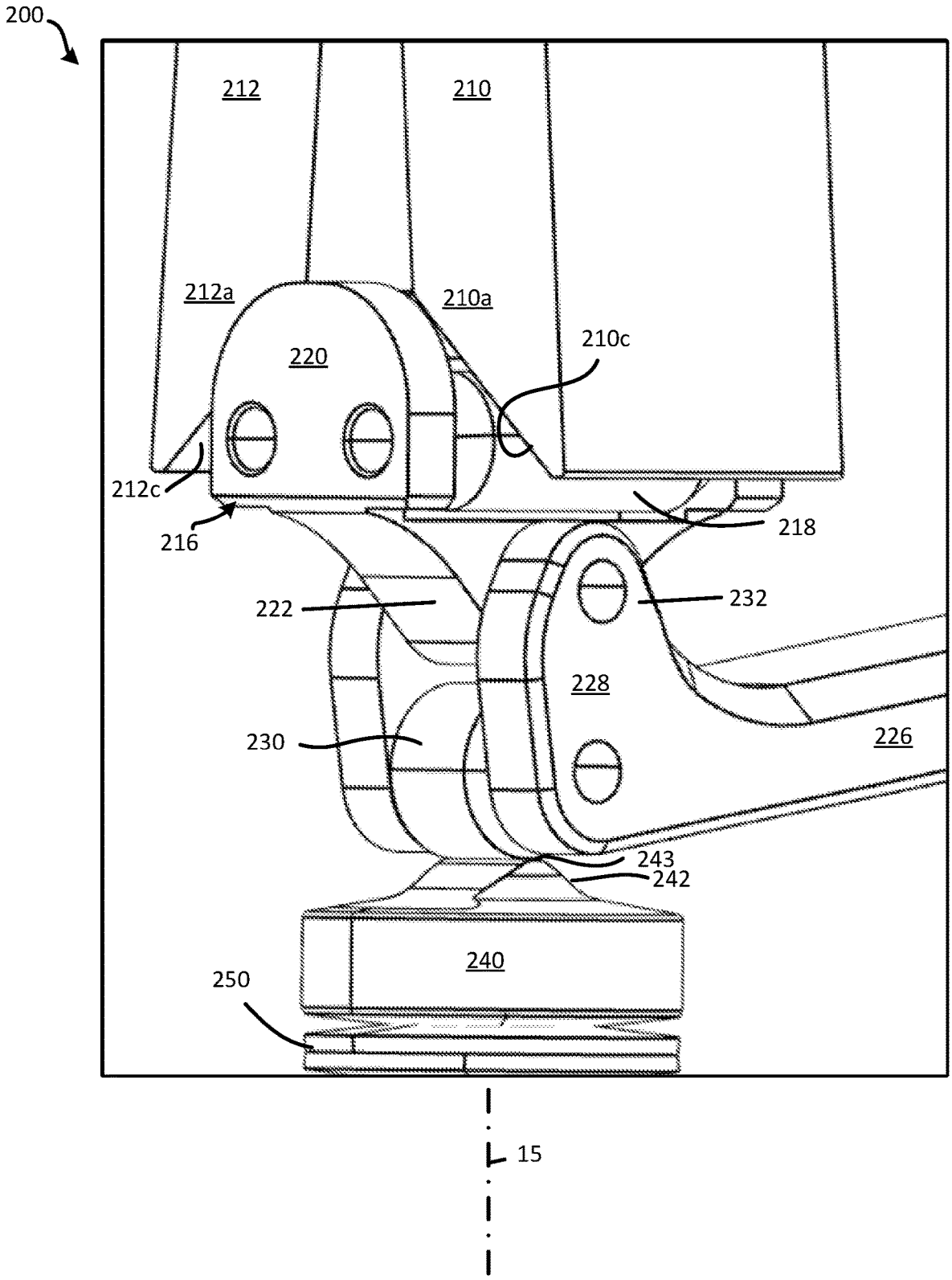
FIG. 6 is a rear perspective view showing components of a cam assembly, in accordance with an embodiment of the present disclosure.

Referring now to FIG. 6, a rear perspective view illustrates components of a clamping assembly 200, in accordance with an embodiment of the present disclosure. In this example, the handle 226 is in the second handle position, resulting in the L-shape of the proximal handle end portion 228 substantially having an axial orientation between the cam 240 and the wedge 216. The wedge 216 includes a roller frame 220 that retains a pair of rollers 218, where each roller 218 engages one of the inside surfaces 210*c*, 212*c* along the proximal end portions 210*a*, 212*a* of the first and second jaws 210, 212. A knuckle 222 on the bottom of the roller frame 220 is pivotably connected to the lever arm 232 of the proximal handle end portion 228. Moving the handle 226 downward to the second handle position causes the follower 230 (a roller in this example) to move to the peak 243 or proximate to the peak 243 of a hill-shaped cam surface 242, moving the proximal handle end portion 228 axially with respect to the cam 240. As a result of the follower 230 moving upward along the cam surface 242 and the proximal handle end portion 228 pivoting to have an axial orientation, the wedge 216 has been advanced along the central clamp axis 15 (e.g., upward) in engagement with the proximal end portions 210*a*, 212*a* of the first and second jaws 210, 212 to pivot the distal end portions 210*b*, 212*b* to the closed position.

Figure 7:
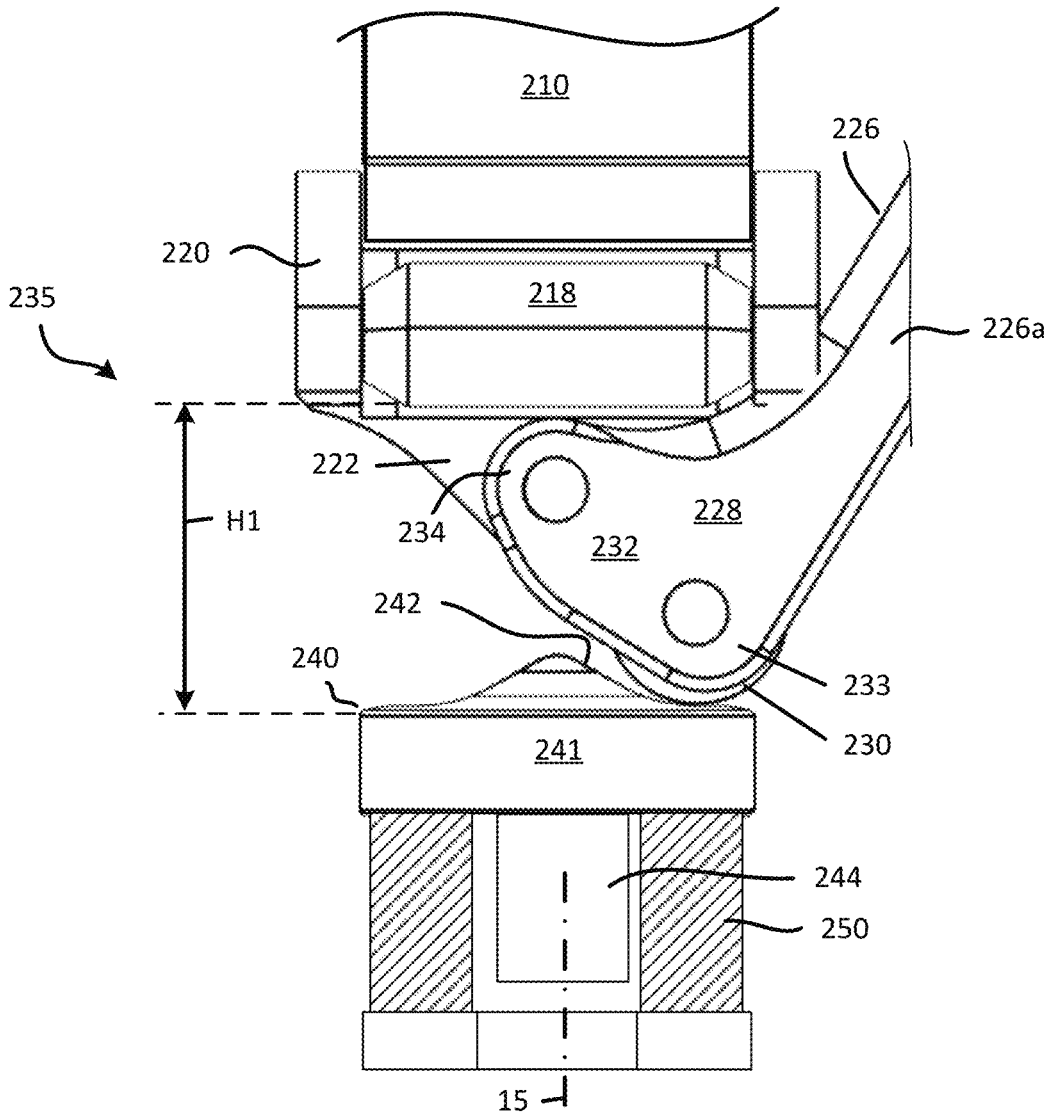
FIG. 7 is a side view showing components of a cam assembly with the handle in a first handle position, in accordance with an embodiment of the present disclosure.
Figure 8:
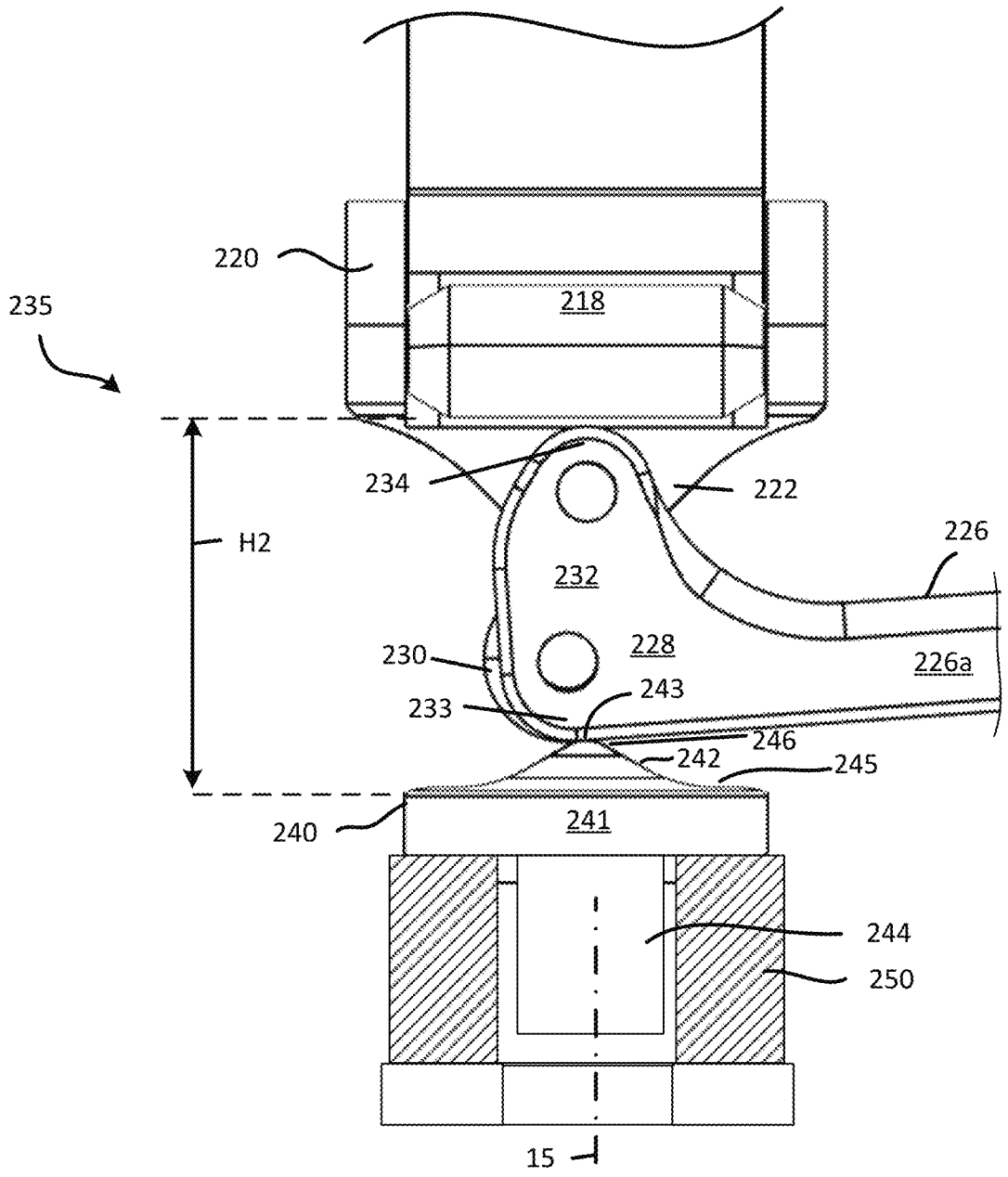
FIG. 8 is a side view showing components of the cam assembly of FIG. 7 with the handle in a second handle position, in accordance with an embodiment of the present disclosure.

FIGS. 7 and 8 illustrate side views of the cam assembly 235, wedge 216, and handle 226 with the handle in the first handle position (FIG. 7) and in the second handle position (FIG. 8), in accordance with an embodiment of the present disclosure. In FIG. 7, the handle 226 is in the first handle position with the elongated handle body 226*a* extending upward at an angle from 45° to 70°, or about 60° with respect to the horizontal. The lever arm 232 of the proximal handle end portion 228 is also inclined upward at an angle of about 30° with respect to the horizontal, thereby defining an angle of about 90° with the remainder of the handle 226. The toe 234 of the proximal handle end portion 228 is pinned to the knuckle 222 on the bottom of the wedge 216, which includes rollers 218 and roller frame 220 in this example. Accordingly, the toe 234 is aligned along the central clamp axis 15. The heel 233 of the proximal handle end portion 228 occupies a position of lowest energy (and lower elevation) on the cam surface 242 towards the radially outer portion of the cam body 241. The wedge 216 has a first axial distance H1 to the cam body 241, measured here between the top of the cam body 241 and the bottom of the roller 218. The spring 250 is in a resting state of little or no axial compression and the cam 240 has a first cam position.

In FIG. 8, the handle 226 has been rotated down to the second handle position and the elongated handle body 226*a* extends horizontally or slightly upward at an angle from 0° to 10°, or about 5° with respect to the horizontal. The lever arm 232 of the proximal handle end portion 228 has been pivoted to a substantially upright or axial position (e.g., a vertical position±10°) on the cam 240. The toe 234 of the proximal handle end portion 228 remains aligned along the central clamp axis 15 and the follower 230 at the heel 233 has moved from the low energy position 245 (lower axial elevation) radially inward along the cam surface 242 to and slightly beyond the peak 243 of the cam surface 242. In this position at or near the center of the cam body 241, the follower 230 occupies a position of higher energy 246 (a higher axial elevation) on the cam surface 242, yet is a lower energy position (lower axial elevation) compared to the highest energy position at the peak 243 of the cam surface 242. In some embodiments, such as shown here, the follower 230 moves up and slightly beyond a peak on the cam surface 242 when the handle 226 is moved to the second handle position. As such, prior to returning the handle 226 to the first handle position, the follower 230 must overcome some force to first travel upward to the peak 243 of the cam surface 242 prior to returning to the position of lowest energy or resting position near the outer portion of the cam body 241 as discussed above with reference to FIG. 7. Thus, the cam assembly 235 resists inadvertent movement to the unclamped position with the handle 226 in the first handle position. In this second handle position, the cam assembly 235 in in a stable clamped position with the jaws 210, 212 in a closed position. The wedge 216 has a second axial distance H2 to the cam body 241, measured here between the top of the cam body 241 and the bottom of the roller 218, where the second axial distance H2 is greater than the first axial distance H1 (FIG. 7). Using rigid materials of construction (e.g., steel, aluminum, or the like), when the first and second jaws 210, 212 (shown in FIG. 1) engage a work piece 10 prior to the follower 230 reaching the peak of the cam surface 242, the spring 250 will become axially compressed, enabling the follower 230 to continue to move up and over the peak 243 of the cam surface 242 to the stable clamped position. In such case, the cam 240 moves axially downward to a second cam position by compression of the spring 250.

Figure 9:
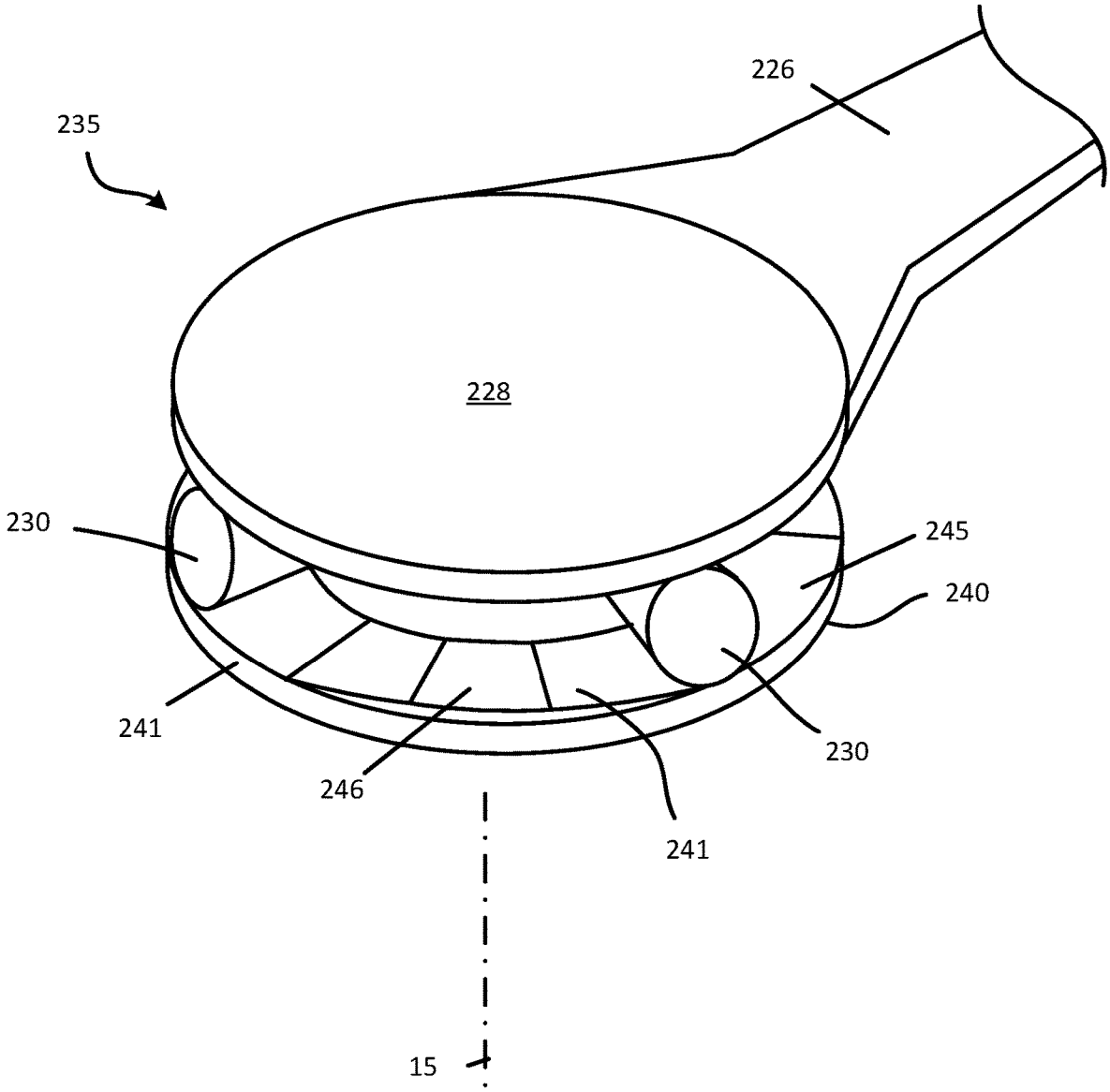
FIG. 9 illustrates a perspective view of a cam assembly in which the handle pivots about the central clamp axis, in accordance with an embodiment of the present disclosure.

FIG. 9 illustrates a perspective view of a cam assembly 235, in accordance with another embodiment of the present disclosure. In this example, the cam 240 is configured as a disk cam with a plurality of cam surfaces 241 distributed in a circular path around the radially outer portion of the cam body 241. As the handle 226 rotates, followers 230 (e.g., rollers) travel along the cam surface 241 between axially lower regions 245 and axially higher regions 246. When the followers 230 occupy the axially higher regions 246, the axial distance increases between the proximal handle end portion 228 and the cam body 241, which can be used to advance the wedge 216 (shown, e.g., in FIG. 8) along the central clamp axis 15.

FURTHER EXAMPLE EMBODIMENTS

The following examples pertain to further embodiments, from which numerous permutations and configurations will be apparent.

Example 1 is a clamping assembly comprising a base and first and second jaws supported above the base in opposed, spaced-apart alignment on opposite sides of a central clamp axis. The first and second jaws each have a proximal end portion adjacent the base and extend to a distal end portion, where the first and second jaws are pivotable between an open position and a closed position. A wedge is movable along the central clamp axis between the proximal end portions of the first and second jaws in response to moving a handle between first and second handle positions. The handle has a proximal handle end portion connected to the wedge, such that moving the handle between the first handle position and the second handle position moves the wedge along the central clamp axis. A cam assembly is between the wedge and the base. The cam assembly includes a cam with a cam surface, a follower on proximal handle end portion and arranged to engage the cam surface, and a spring between the cam and the base. Compressing the spring increases an axial distance between the cam and the wedge. In use, moving the handle from the first handle position to the second handle position advances the wedge between the proximal end portions of the first and second jaws to pivot the distal end portion of the first jaw toward the distal end portion of the second jaw.

Example 2 includes the subject matter of Example 1, wherein if the distal end portions of the jaws engage a workpiece prior to the handle moving fully to the second handle position, compressing the spring enables additional movement of the handle toward the second handle position.

Example 3 includes the subject matter of Example 2, wherein the base defines a spring well, and the spring is received in the spring well.

Example 4 includes the subject matter of Example 3, further comprising a body received in the spring well, the body movable along the central clamp axis, wherein the spring is between the body and the cam.

Example 5 includes the subject matter of Example 4, wherein the body threadably engages the spring well such that rotating the body in the spring well moves the body along the central clamp axis.

Example 6 includes the subject matter of Example 4 or 5, wherein the body comprises a base plate that threadably engages the spring well such that rotating the base plate moves the base plate along the central clamp axis.

Example 7 includes the subject matter of Example 6, wherein the base plate has an annular geometry.

Example 8 includes the subject matter of any of Examples 4-6, wherein the body is configured as a receptacle, wherein the receptacle is received in the spring well and the spring is received in the receptacle.

Example 9 includes the subject matter of Example 8, wherein the receptacle comprises a cylindrical cup.

Example 10 includes the subject matter of Example 8 or 9, wherein the receptacle threadably engages the spring well such that rotating the receptacle moves the receptacle along the central clamp axis.

Example 11 includes the subject matter of any of Examples 1-10, wherein the proximal handle end portion rotates about the central clamp axis when the handle moves from the first handle position to the second handle position.

Example 12 includes the subject matter of any of Examples 1-10, wherein moving the handle from the first handle position to the second handle position includes pivoting the handle downward.

Example 13 includes the subject matter of Example 12, wherein the proximal handle end portion includes a toe connected to the wedge and a heel spaced from the toe, wherein the heel includes the follower.

Example 14 includes the subject matter of Example 13, wherein the follower comprises a roller.

Example 15 includes the subject matter of Example 14, wherein the cam surface includes an axially lower region adjacent a radially outer portion of the cam and an axially higher region adjacent a center of the cam, wherein moving the handle from the first handle position to the second handle position includes the roller moving along the cam surface from the axial lower region to the axially higher region.

Example 16 includes the subject matter of Example 15, wherein the cam surface includes a protrusion that is aligned with the central clamp axis and extends axially from the cam towards the wedge.

Example 17 includes the subject matter of Example 16, wherein the axially higher region includes a peak, and moving the handle to the second handle position includes the roller moving over the peak.

Example 18 includes the subject matter of any of Examples 1-17, wherein the wedge includes a first roller positioned to engage the first jaw and a second roller positioned to engage the second jaw.

Example 19 includes the subject matter of any of Examples 1-18, wherein the spring comprises one of a helical coil spring, a polymer spring, a disc spring, or a Belleville washer.

Example 20 includes the subject matter of any of Examples 1-19, wherein the central clamp axis is a vertical axis.

Example 21 is a sharpening apparatus including the clamping assembly of any of Examples 1-20.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A clamping assembly comprising:

a base;

first and second jaws supported above the base in opposed, spaced-apart alignment on opposite sides of a central clamp axis, the first and second jaws each having a proximal end portion adjacent the base and extending to a distal end portion, wherein the first and second jaws are pivotable between an open position and a closed position;

a wedge movable along the central clamp axis between the proximal end portions of the first and second jaws;

a handle having a proximal handle end portion connected to the wedge, the handle operable between a first handle position and a second handle position, wherein moving the handle between the first handle position and the second handle position moves the wedge along the central clamp axis; and a cam assembly between the wedge and the base, the cam assembly comprising:

a cam with a cam surface;

a follower on the proximal handle end portion and arranged to engage the cam surface; and a spring between the cam and the base, wherein compressing the spring increases an axial distance between the cam and the wedge;

wherein moving the handle from the first handle position to the second handle position advances the wedge between the proximal end portions of the first and second jaws to pivot the distal end portion of the first jaw toward the distal end portion of the second jaw.

2. The clamping assembly of claim 1, wherein if the distal end portions of the first and second jaws engage a workpiece prior to the handle moving fully to the second handle position, compressing the spring enables additional movement of the handle toward the second handle position.

3. The clamping assembly of claim 2, wherein the base defines a spring well, the spring received in the spring well.

4. The clamping assembly of claim 3, further comprising a body received in the spring well, the body movable along the central clamp axis, wherein the spring is between the body and the cam.

5. The clamping assembly of claim 4, wherein the body threadably engages the spring well such that rotating the body in the spring well moves the body along the central clamp axis.

6. The clamping assembly of claim 4, wherein the body comprises a base plate that threadably engages the spring well such that rotating the base plate moves the base plate along the central clamp axis.

7. The clamping assembly of claim 6, wherein the base plate has an annular geometry.

8. The clamping assembly of claim 4, wherein the body is configured as a receptacle, wherein the receptacle is received in the spring well and the spring is received in the receptacle.

9. The clamping assembly of claim 8, wherein the receptacle comprises a cylindrical cup.

10. The clamping assembly of claim 9, wherein the receptacle threadably engages the spring well such that rotating the receptacle moves the receptacle along the central clamp axis.

11. The clamping assembly of claim 1, wherein the proximal handle end portion rotates about the central clamp axis when the handle moves from the first handle position to the second handle position.

12. The clamping assembly of claim 1, wherein moving the handle from the first handle position to the second handle position includes pivoting the handle downward.

13. The clamping assembly of claim 12, wherein the proximal handle end portion includes a toe connected to the wedge and a heel spaced from the toe, wherein the heel includes the follower.

14. The clamping assembly of claim 13, wherein the follower comprises a roller.

15. The clamping assembly of claim 14, wherein the cam surface includes an axially lower region adjacent a radially outer portion of the cam and an axially higher region adjacent a center of the cam, wherein moving the handle from the first handle position to the second handle position includes the roller moving along the cam surface from the axially lower region to the axially higher region.

16. The clamping assembly of claim 15, wherein the cam surface includes a protrusion that is aligned with the central clamp axis and extends axially from the cam towards the wedge.

17. The clamping assembly of claim 16, wherein the axially higher region includes a peak, and moving the handle to the second handle position includes the roller moving over the peak.

18. The clamping assembly of claim 1, wherein the wedge includes a first roller positioned to engage the first jaw and a second roller positioned to engage the second jaw.

19. The clamping assembly of claim 1, wherein the spring comprises one of a helical coil spring, a polymer spring, a disc spring, or a Belleville washer.

20. The clamping assembly of claim 1, wherein the central clamp axis is a vertical axis.

* * * * *